US010096412B2

(12) United States Patent
Kato et al.

(10) Patent No.: US 10,096,412 B2
(45) Date of Patent: Oct. 9, 2018

(54) RARE EARTH BASED MAGNET

(71) Applicant: TDK CORPORATION, Tokyo (JP)

(72) Inventors: Eiji Kato, Tokyo (JP); Yoshinori Fujikawa, Tokyo (JP); Taeko Tsubokura, Tokyo (JP); Chikara Ishizaka, Tokyo (JP); Katsuo Sato, Ichikawa (JP)

(73) Assignee: TDK CORPORATION, Tokyo (JP)

( * ) Notice: Subject to any disclaimer, the term of this patent is extended or adjusted under 35 U.S.C. 154(b) by 446 days.

(21) Appl. No.: 14/228,808

(22) Filed: Mar. 28, 2014

(65) Prior Publication Data

US 2014/0290803 A1 Oct. 2, 2014

(30) Foreign Application Priority Data

Mar. 28, 2013 (JP) ..... 2013-067863
Dec. 20, 2013 (JP) ..... 2013-263369

(51) Int. Cl.

*H01F 1/153* (2006.01)
*H01F 1/053* (2006.01)
*H01F 1/057* (2006.01)
*H01F 41/02* (2006.01)

(52) U.S. Cl.

CPC ..... *H01F 1/0577* (2013.01); *H01F 41/0273* (2013.01)

(58) Field of Classification Search

CPC .. H01F 1/0577; H01F 41/0253; H01F 1/0536; H01F 1/0557; H01F 7/02
See application file for complete search history.

(56) References Cited

U.S. PATENT DOCUMENTS

2010/0230013 A1 9/2010 Nakajima
2012/0024429 A1 2/2012 Hayakawa et al.
2013/0092868 A1 4/2013 Nakajima et al.
2013/0099150 A1 4/2013 Nakajima et al.
2013/0284969 A1* 10/2013 Kim ..... H01F 1/01 252/62.57
2014/0132377 A1 5/2014 Nakajima et al.
2016/0180993 A1* 6/2016 Kanada ..... C22C 38/00 252/62.55

(Continued)

FOREIGN PATENT DOCUMENTS

CN 101888909 A 11/2010
EP 0651401 A1 5/1995

(Continued)

OTHER PUBLICATIONS

Fidler (Scripta Metallurgica et Materialia, 1995, vol. 33, p. 1781-1791).*

(Continued)

*Primary Examiner* — Xiaowei Su
(74) *Attorney, Agent, or Firm* — Oliff PLC

(57) ABSTRACT

The present invention provides a rare earth based magnet including $R_2T_{14}B$ main-phase crystal grains, and two-grain boundary phases between adjacent two $R_2T_{14}B$ main-phase crystal grains, the two-grain boundary phases are controlled such that the thickness thereof is 5 nm or more and 500 nm or less, and it is composed of a phase with a magnetism different from that of a ferromagnet.

14 Claims, 5 Drawing Sheets

(56) References Cited

U.S. PATENT DOCUMENTS

2016/0196904 A1* 7/2016 Kanada ..... C22C 38/00
420/83

FOREIGN PATENT DOCUMENTS

| | | | |
|---|---|---|---|
| JP | H11-273919 | A | 10/1999 |
| JP | A-2002-327255 | | 11/2002 |
| JP | 2004-111481 | A | 4/2004 |
| JP | 2011-082365 | A | 4/2011 |
| JP | A-2012-15168 | | 1/2012 |
| JP | A-2012-15169 | | 1/2012 |
| JP | 2012-028704 | A | 2/2012 |
| WO | WO-2013/008756 | A1 | 1/2013 |

OTHER PUBLICATIONS

Tokunaga (Proc. Of the MRS International Meeting on Advanced Materials, vol. 11, Mater. Res. Soc.: Pittsburgh, 1989, p. 53-67).*

* cited by examiner

RARE EARTH BASED MAGNET

The present invention relates to a rare earth based magnet, more specifically, to a rare earth based magnet for which the microstructure of the R-T-B based sintered magnet is controlled.

BACKGROUND

The R-T-B based sintered magnet (R represents a rare earth element, T represents one or more elements of the iron group with Fe as an essential element, and B represents boron), a representative of which is Nd—Fe—B based sintered magnet, is advantageous for miniaturization and high efficiency of the machines used due to high saturation magnetic flux density, and thus can be used in a voice coil motor of a hard disk drive, etc. Recently, it is also suitable for use in various industrial motors or drive motors of hybrid vehicles, etc., and it is desired to be further popularized in these fields from the viewpoint of energy conservation, etc. However, when applied in the hybrid vehicles and the like, the R-T-B based sintered magnet will be exposed to a high temperature, and thus the suppression on demagnetization at high temperature caused by heat becomes important. Regarding said suppression on demagnetization at high temperatures, it is well known that the method of increasing the coercivity (Hcj) at room temperature of an R-T-B based sintered magnet is effective.

For example, as a method for increasing the coercivity (Hcj) at room temperature of an Nd—Fe—B based sintered magnet, a method using heavy rare earth element such as Dy, Tb to replace part of Nd in the compound $Nd_2Fe_{14}B$ which acts as the main phase is well-known. By replacing part of Nd with heavy rare earth element, the magneto-crystalline anisotropy can be increased, and consequently, the coercivity at room temperature of the Nd—Fe—B based sintered magnet may be increased sufficiently. In addition to the replacing method with heavy rare earth element, it is also effective to add elements such as Cu in increasing the coercivity at room temperature (Patent Document 1). It is considered that by adding of the Cu element, the Cu element forms, e.g., an Nd—Cu liquid phase, at the grain boundary, and hence the grain boundary becomes smooth, inhibiting nucleation of reverse magnetic domains.

In another aspect, Patent Document 2 and Patent Document 3 have disclosed the technology for enhancing the coercivity by controlling the grain boundary phases which act as the microstructure of a rare earth based magnet. It may be derived from the drawings in these patent documents that, the grain boundary phases as mentioned herein refer to grain boundary phases surrounded by three or more main-phase crystal grains, i.e., triple junctions. Patent Document 2 has disclosed a technology for constructing two kinds of triple junctions with different Dy concentrations. That is, it has disclosed that by forming a part of grain boundary phases (triple junctions) with higher Dy concentration without increasing the entire Dy concentrations, a high resistance to the reversal of the magnetic domain can be provided. Patent Document 3 has disclosed such a technology in which, three, i.e., first, second and third grain boundary phases (triple junctions) which are different in total atomic concentrations of rare earth element is formed, the atomic concentration of rare earth element of the third grain boundary phases is lower than that of the other two kinds of grain boundary phases, and in addition, the atomic concentration of the Fe element of the third grain boundary phases is higher than that in the other two grain boundary phases. As a result, third grain boundary phases containing a high concentration of Fe are formed among the grain boundary phases, which can induce the effect of increasing the coercivity. Further, Patent Document 4 has disclosed a R-T-B-based rare earth-based sintered magnet which is consisted of a sintered body having a main phase mainly containing $R_2T_{14}B$ and grain boundary phases containing more R than the main phase, with said grain boundary phases comprising: a phase with the total atomic concentration of rare earth element being 70 at % or more and a phase with the total atomic concentration of the above-mentioned rare earth element being 25 to 35 at %. It also has disclosed that the above-mentioned phase with the total atomic concentration of the rare earth element being 25 to 35 at % is named a transition metal-rich phase, and the atomic concentration of Fe in said transition metal-rich phase is preferably 50 to 70 at %. As such, the effect of increasing the coercivity is achieved.

PATENT DOCUMENTS

Patent Document 1: Japanese Patent JP-A No. 2002-327255
Patent Document 2: Japanese Patent JP-A No. 2012-15168
Patent Document 3: Japanese Patent JP-A No. 2012-15169
Patent Document 4: International Publication Pamphlet No. 2013/008756

SUMMARY

Although in a situation of using R-T-B based sintered magnet at an environment with a high temperature of 100° C. to 200° C., the value of the coercivity at room temperature is one of the effective indexes, it is very important that demagnetization does not occur or the demagnetization rate is low even when the magnet is actually exposed to an environment with a high temperature. Although the coercivity of the composition where part of R of the compound $R_2T_{14}B$ which acts as the main phase is replaced by the heavy rare earth element such as Tb or Dy is improved remarkably and this is a simple method to get a high coercivity, there are problems in the resources since the heavy rare earth elements such as Dy and Tb are limited in geographical origins and yields. Accompanying with the replacement, it is unavoidable for the residual magnetic flux density (Br) to decrease due to antiferromagnetic coupling of Nd and Dy. Addition of Cu as described above and the like are also effective to get a high coercivity. Nonetheless, in order to enlarge the applicable field of the R-T-B based sintered magnet, it is desirable that the suppression on demagnetization at high temperature (demagnetization due to exposure to a high temperature environment) is further enhanced.

In order to increase the coercivity of rare earth based magnets, i.e., R-T-B based sintered magnets, it is well known that in addition to the above method of adding Cu element, it is important to control the grain boundary phases which act as the microstructure. The grain boundary phases include a so-called two-grain boundary phase formed between adjacent two main-phase crystal grains, and a so-called triple junction surrounded by three or more main-phase crystal grains as mentioned above.

For increasing the coercivity of rare earth based magnets, it is important to cut off the magnetic coupling between $R_2T_{14}B$ crystal grains which act as the main phase. If the every main-phase crystal grains can be isolated magnetically, then the reverse magnetic domain, even generated in a certain crystal grain, will not affect the adjacent crystal grains, and thus the coercivity can be increased. The inventors of the present application believe that in order to impart the magnetic cutting-off effect between adjacent crystal grains to rare earth based magnets, controlling the above two-grain boundary phases is more important than controlling the above triple junctions and the inventors discussed the various rare earth based magnets in the prior art. As a result, a technical problem is recognized, i.e., the extent of the cutting off for magnetic coupling in the two-grain boundary phases of the current rare earth based magnets is not sufficient yet. That is, the current two-grain boundary phases formed between two main-phase crystal grains is as thin as 2 to 3 nm, which will not generate a sufficient cutting-off effect on magnetic bond. It is considered that a sufficient cutting-off effect on magnetic coupling can be obtained by just extremely thickening the grain boundary phases. However, when only increasing the ratio of R in the composition of the alloy raw materials for thickening the two-grain boundary phase, a phase with a relatively high concentration of the rare earth element R (R-rich phase) is segregated to form a triple junction, and the thickness of the two-grain boundary phases is not increased, while the residual magnetic flux density is extremely lowered, which is problematic in actual use. Additionally, in a situation of increasing the atomic concentration of Fe element in the triple junction, the concentration of the rare earth element R in the two-grain boundary phases cannot be increased, which would fail to generate a sufficient cutting-off effect on magnetic coupling; in addition, it tends to form a nuclei of reverse magnetic domains easily since the triple junction turns into a ferromagnetic phase, which is causative for decrease of the coercivity. Thus, the technical problem, i.e., the extent of the cutting off for magnetic coupling in the adjacent crystal grains of current rare earth based magnet is not sufficient yet, has been recognized.

In view of the above circumstances, the present invention is aimed to provide a rare earth based magnet for which the suppression on high-temperature demagnetization rate is improved by controlling the two-grain boundary phases, which acts as the microstructure of the rare earth based magnet.

The inventors of the present application conducted a special research regarding structures of grain boundary phases that can extraordinarily improve the suppression on high-temperature demagnetization rate, and consequently, completed the following invention.

That is, the rare earth based magnet according to this invention is characterized in containing $R_2T_{14}B$ crystal grains as the main phase and two-grain boundary phases between adjacent two $R_2T_{14}B$ crystal grains, with said two-grain boundary phases having a thickness of 5 nm or more and 500 nm or less, and being composed of a phase having a magnetism different from that of the ferromagnet. The phase having a magnetism different from that of the ferromagnet as mentioned herein includes antiferromagnets, ferrimagnetisms, weak magnetic bodies generated by a slight incline of the anti-parallel magnetic moment from an anti-parallel state, or non-magnetic bodies, etc, wherein the phase substantially exhibits no magnetism or a weak magnetism, and it produces, together with the thickness of the two-grain boundary phases, a magnetic cutting-off effect between adjacent main-phase crystal grains, which can suppress the high-temperature demagnetization rate. When the thickness of the two-grain boundary phases is smaller than 5 nm, only a coercivity in the same degree as the current coercivity can be obtained, which fails to extraordinarily improve the suppression on high-temperature demagnetization rate. In addition, if the thickness of the two-grain boundary phases exceeds 500 nm, although the coercivity may be increased and the high-temperature demagnetization rate can be suppressed, the volume percentage occupied by the two-grain boundary phases in overall increases and the residual magnetic flux density lowers, which is problematic in actual use. Further, the method for evaluating the width (thickness) of the two-grain boundary phases is described hereinafter.

In the rare earth based magnet related in the present invention, the two-grain boundary phases formed between adjacent $R_2T_{14}B$ main-phase crystal grains are preferably composed of R-rich phases, the atomic concentration of the rare earth element contained in said R-rich phases is preferably 60 at % or more, further preferably 90 at % or more. The thus-formed two-grain boundary phases turn into non-magnetic grain boundary phases, by which the cutting-off effect on magnetic coupling between adjacent $R_2T_{14}B$ main-phase crystal grains can be improved, and thus the high-temperature demagnetization rate can be suppressed. As the rare earth element R, from the viewpoint of a desired abundance and a stable price, Nd and Pr are preferred. In the R-rich phases for forming said two-grain boundary phases, Cu or Co or the like well-known additives, or the aftermentioned Ga for forming the grain boundary phase compound, and so on may also be contained. Even when containing such elements, said two-grain boundary phases are nonferromagnetic since the atomic concentration of the rare earth element R is 60 at % or more.

The above R-rich phases are preferably microcrystal, or amorphous substance, or microcrystal containing amorphous substance. By forming such a structure, distortion produced based on lattice mismatch may be suppressed in the boundary between the $R_2T_{14}B$ main-phase crystal grains and the R-rich phases, and thus preventing formation of a reverse magnetic domain-generating nuclei. The microcrystal as mentioned herein refers to a grain with a diameter smaller than the width of the two-grain boundary phases, and the diameter is preferably 10 nm or less. In the transmission electron microscopy, the amorphous phase can be determined as a halo pattern in a selected-area electron diffraction picture, and the microcrystal can be determined by observing the crystals per se.

In addition, in the rare earth based magnet related in the present invention, the two-grain boundary phases formed between adjacent $R_2T_{14}B$ main-phase crystal grains may be a compound containing iron group elements such as Fe, Co and the like, preferably a $R_6T_{13}M$ phase with a $La_6Co_{11}Ga_3$-type crystal structure (M being at least one selected from Al, Ge, Si, Sn, and Ga). In such two-grain boundary phases, even Fe, Co and the like iron group elements are contained, by incorporating the iron group element T as a component element of the compound, a kind of nonferromagnetic two-grain boundary phase can still be formed, and the cutting-off effect on magnetic coupling between adjacent $R_2T_{14}B$ main-phase crystal grains can be improved, and the high-temperature demagnetization rate can be suppressed.

The above $R_6T_{13}M$ phase preferably has such a crystallinity that lattice fringes can be observed in a high-resolution transmission electron microscopy (HRTEM). With the crystal growth of the $R_6T_{13}M$ phases which act as the two-grain boundary phases realized in this way, wide and uniform grain boundary phases may be formed. Further, a thin microcrystal layer, an amorphous layer or a microcrystal-containing amorphous layer is preferably formed in the boundary between the $R_2T_{14}B$ main-phase crystal grains and the $R_6T_{13}M$ phase. The thickness of the herein-mentioned thin microcrystal layer, an amorphous layer or a microcrystal-containing amorphous layer in the boundary between the $R_2T_{14}B$ main-phase crystal grains and the $R_6T_{13}M$ phases is no less than 0.5 nm, and it may be 1/10 of the thickness of the $R_6T_{13}M$-phase two-grain boundary phases or less. Moreover, said thin microcrystal layer, the amorphous layer or the microcrystal-containing amorphous layer is preferably an R—Cu phase. Accordingly, distortion produced based on lattice mismatch may be suppressed in the boundary between the $R_2T_{14}B$ main-phase crystal grains and the $R_6T_{13}M$ phases, and thus preventing the formation of a reverse magnetic domain-generating nuclei.

Further, in the rare earth based magnet related in the present invention, the two-grain boundary phases formed between the adjacent $R_2T_{14}B$ main-phase crystal grains preferably contain a first two-grain boundary phase composed of the above R-rich phases, and a second two-grain boundary phase composed of the above $R_6T_{13}M$ phase. With such a configuration, since the T atoms (e.g., Fe atoms) are consumed in the form of the $R_6T_{13}M$ compound which will otherwise be segregated in the R-rich two-grain boundary phases such as R—Cu and the like in the prior art, iron group elements in the R-rich phases may be extremely reduced, and thus both the first two-grain boundary phase and the second two-grain boundary phase may turn into nonferromagnetic grain boundary phases. Accordingly, the cutting-off effect on magnetic coupling between $R_2T_{14}B$ main-phase crystal grains can be improved and the high-temperature demagnetization rate can be suppressed.

The rare earth based magnet related in the present invention has the following characteristics, i.e., by making the width of the two-grain boundary phases between adjacent two main-phase crystal grains larger than the value observed in the prior art, and using a nonmagnetic material or an extremely-weak magnetic material to compose the two-grain boundary phases, the cutting-off effect on magnetic coupling generated by said two-grain boundary phases can be extraordinarily improved.

According to the present invention, a rare earth based magnet with a low high-temperature demagnetization rate can be provided, and a rare earth based magnet that can be applicable to motors and the like for use in a high temperature environment can be provided.

DETAILED DESCRIPTION OF EMBODIMENTS

Preferable embodiments of the present invention are described hereinafter along with reference to the drawings. In addition, the rare earth based magnet as mentioned in this invention refers to a sintered magnet containing $R_2T_{14}B$ main-phase crystal grains and two-grain boundary phases, and to a magnet in which R contains one or more rare earth elements, T contains one or more iron group elements with Fe as an essential element, B is contained, and various well-known elements for additives are further contained.

Figure 1:
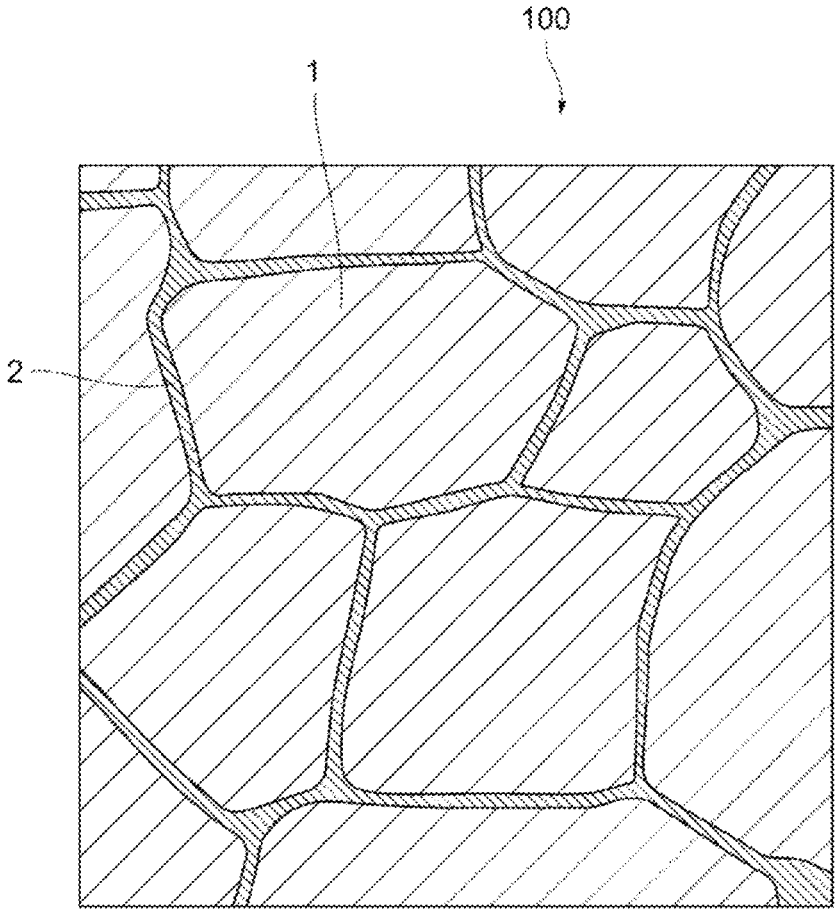
FIG. 1 is a sectional diagram schematically representing the main-phase crystal grains and the two-grain boundary phases of the rare earth based magnet related in the present invention.

FIG. 1 is a diagram schematically representing the sectional configuration of the rare earth based magnet of an embodiment related in the present invention. The rare earth based magnet according to this embodiment is characterized in, containing $R_2T_{14}B$ main-phase crystal grains 1, and two-grain boundary phases 2 formed between adjacent $R_2T_{14}B$ main-phase crystal grains 1, wherein the width in the section of said two-grain boundary phases 2 is 5 nm to 500 nm.

The width (thickness) of the two-grain boundary phases 2 in this embodiment is constructed extraordinarily wide compared with a width of 2 to 3 nm, i.e., a width of the two-grain boundary phases in a general rare earth based magnet. It is not necessary that all the widths of the two-grain boundary phases in the entire region surrounding the $R_2T_{14}B$ main-phase crystal grains are within said width range. Even though there are areas with a small thickness of grain boundary phase partially, the probability of occurrence of the reverse magnetic domain can be suppressed to be low by comprising the grain boundary phases with said width described above in certain portion. The ratio of thick two-grain boundary phases may be 20% or more.

Figure 2:
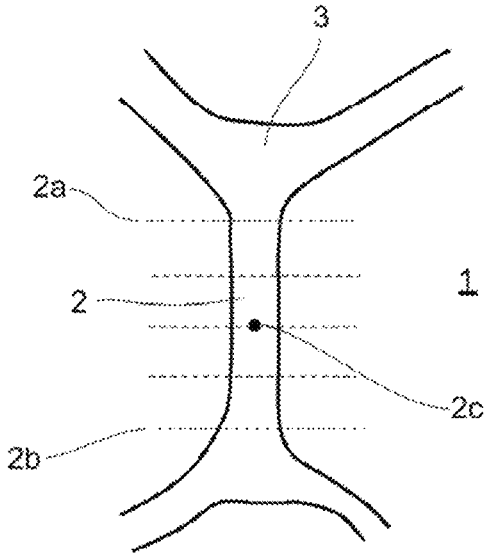
FIG. 2 is schematic diagram describing the method for measuring the width of the two-grain boundary phases.

The width of the two-grain boundary phases (the thickness of the boundary phase) in this invention refers to an average value of the measuring values of 60 points. FIG. 2 is a schematic diagram which specifically represents the method for measuring the width of the two-grain boundary phases of this embodiment. Two-grain boundary phases 2 and triple junctions 3 are formed between the adjacent $R_2T_{14}B$ main-phase crystal grains 1. Focusing on one two-grain boundary phase 2 as the measuring object, the boundaries 2*a*, 2*b* between said two-grain boundary phase and the triple junctions 3 connecting thereto are determined. The vicinities of the boundaries 2*a*, 2*b* are not to be measured, and thus high accuracy is not a necessity. Once the boundaries 2*a*, 2*b* are determined, the interval is quadrisected and three quadrisectors are drawn. Taking the positions of the three quadrisectors as points for determining the width of the two-grain boundary phases, yielding measured values of three points. Said determination is conducted to the 20 two-grain boundary phases arbitrarily selected to be focused on, and the average of the measured values of the total 60 measuring points is deemed as the thickness (width) of the two-grain boundary phases.

In the present invention, the above ratio of the thick two-grain boundary phases refers to, among the total 60 measuring points for which the two-grain boundary phase widths are measured, a ratio occupied by the measuring points which are composed of a phase with a magnetism different from that of a ferromagnet (also is referred to as a phase satisfying the magnetism in the present specification) with the thickness of the two-grain boundary phases being 5 nm or more. In addition, in the present specification, as shown in FIG. 2, on the line bisecting the boundaries 2*a*, 2*b*, the midpoint in the width direction of the two-grain boundary phase is regarded as the midpoint 2*c* of the two-grain boundary phase.

In the $R_2T_{14}B$ main-phase crystal grains composing the rare earth based magnet according to this embodiment, as the rare earth R, it may be any one of a light rare-earth element, a heavy rare-earth element, or a combination of both, and Nd, Pr or the combination thereof is preferred from the viewpoint of material costs. As the iron group element T, Fe or the combination of Fe and Co is preferred, but is not limited thereto. In addition, B represents boron. In the sintered magnet of this embodiment, the contents of the elements relative to the total mass are shown as follows. In addition, mass % is regarded as the same unit with "weight %" in the present specification.

R: 29.5 to 33 mass %;

B: 0.7 to 0.95 mass %;

M: 0.03 to 1.5 mass %;

Cu: 0.01 to 1.0 mass %; and

Fe: balance, substantially; and

The total content of elements other than Fe occupying the balance: 5 mass % or lower.

Hereinafter, more detailed description is provided on contents of the elements or atomic ratios and the like conditions.

The content of R in the sintered magnet is 29.5 to 33 mass %. In a condition where a heavy rare earth element is contained as R, the total content of rare earth elements including the heavy rare earth element is within said range. A heavy rare earth element refers to an element with a larger atom number among the rare earth elements, and generally, rare earth elements from $_{64}$Gd to $_{71}$Lu correspond to said heavy rare earth elements. If the content of R is within said range, it tends to get a high residual magnetic flux density and coercivity. If the content of R is lower than said range, it will be hard to form the $R_2T_{14}B$ phase as the main phase, but tends to form a α-Fe phase with soft magnetism easily, and consequently, the coercivity is decreased. In another aspect, if the content of R is larger than said range, the volume percentage of the $R_2T_{14}B$ phase becomes lower, and the residual magnetic flux density is reduced. The content of R can be 30.0 to 32.5 mass %. If within such a range, the volume percentage of the $R_2T_{14}B$ phase which acts as the main phase becomes very high, and further it becomes possible to get a favorable residual magnetic flux density.

As R, either of Nd and Pr must be contained, and the ratio of Nd and Pr (calculated by a total of Nd and Pr) in R can be 80 to 100 at %, and it may be 95 to 100 at %. If within such a range, a favorable residual magnetic flux density and coercivity can be further obtained.

As set forth above, the sintered magnet may also contain Dy, Tb, Ho and the like heavy rare earth elements as R, and in this situation, the content of heavy rare earth elements (calculated as the total of heavy rare earth elements) in total mass of the sintered magnet is 1.0 mass % or less, preferably 0.5 mass % or less, further preferably 0.1 mass % or less. If it is a sintered magnet of this embodiment, even the contents of heavy rare earth elements are reduced like this, a favorable and high coercivity can still be obtained by rendering contents of other elements and the atomic ratios satisfying certain requirements.

The rare earth based magnet according to this embodiment further contains trace additive elements. As the additive elements, common additive elements may be used. The additive elements are preferably those having an eutectic point in the phase diagram with the constituent element, R, of the $R_2T_{14}B$ main-phase crystal grains. From this viewpoint, the additive elements may preferably be Cu, etc., while it may also be other elements. As the amount of Cu added, it may be 0.01 to 1.0 mass % of the total mass. By allowing the adding amount to be within such a range, Cu can generally unevenly distribute only in the grain boundary phases.

In the rare earth based magnet according to this embodiment, the two-grain boundary phases further contain T element, and contains elements for forming compounds which will not be ferromagnetic. For this purpose, Al, Ge, Si, Sn, Ga and the like M elements are preferably added. By adding these elements in the rare earth based magnet other than Cu, a crystal phase with a $La_6Co_{11}Ga_3$-type crystal structure having a good crystallinity may be evenly and broadly formed as the two-grain boundary phases. A thin R—Cu layer may be formed on the boundary between said $La_6Co_{11}Ga_3$-type two-grain boundary phases and the $R_2T_{14}B$ main-phase crystal grains, as a result, the boundary is rendered smooth, occurrence of distortion due to lattice mismatch and so on can be suppressed, and a reverse magnetic domain-generating nuclei may be inhibited. In the sintered magnet, the content of M is 0.03 to 1.5 mass %. If the content of M is less than said range, the coercivity becomes insufficient; if larger than said range, the saturation magnetization reduces, and the residual magnetic flux density becomes insufficient. In order to obtain a coercivity and a residual magnetic flux density better, the content of M may also be 0.13 to 0.8 mass %.

In addition to the above elements, the sintered magnet of this embodiment further contains Fe and other elements, and among the total mass of the sintered magnet, Fe and other elements occupy the balance other than the total contents of the above elements. However, in order to allow the sintered magnet functions sufficiently as a magnet, among the elements occupying the balance, the total content of elements other than Fe is preferably 5 mass % or less relative to the total mass of the sintered magnet.

In addition, likewise, Co is an element represented by T in the basic composition $R_2T_{14}B$, forming a same phase as Fe. The sintered magnet may contain Co. In this situation, the content of Co is preferably larger than 0 mass % and is 3.0 mass % or less. By comprising a Co-containing phase in the sintered magnet, the corrosion resistance of the grain boundary phases is increased in addition to an increase of Curie temperature, thereby forming a magnet which has an increased corrosion resistance as a whole. In order to achieve the effect better, the content of Co may also be 0.3 to 2.5 mass %.

In addition, the content of C is 0.05 to 0.3 mass %. If the content of C is lower than said range, the coercivity will be insufficient; if larger than said range, the ratio of the magnetic field value (Hk) when the magnetization is 90% of residual magnetic flux density, with respect to coercivity, i.e. the squareness ratio (Hk/HcJ) becomes insufficient. In order to obtain the coercivity and the squareness ratio better, the content of C may also be 0.1 to 0.25 mass %.

In addition, the content of O is 0.03 to 0.4 mass %. If the content of O is lower than said range, the corrosion resistance of the sintered magnet will be insufficient; if larger than said range, a liquid phase cannot be sufficiently formed in the sintered magnet and the coercivity will decrease. In order to obtain the corrosion resistance and the coercivity better, the content of O may be 0.05 to 0.3 mass %, and also may be 0.05 to 0.25 mass %.

In the sintered magnet, Zr for example may be contained as the other elements. In this situation, the content of Zr in total mass of the sintered magnet is preferably 0.25 mass % or less. Zr may inhibit the abnormal growth of crystal grains during the production of the sintered magnet, rendering the structure of the obtained sintered body (the sintered magnet) uniform and fine, which may improve the magnetic characteristic. In order to obtain the effect better, the content of Zr may also be 0.03 to 0.25 mass %.

The sintered magnet may also contain 0.001 to 0.5 mass % of inevitable impurities like Mn, Ca, Ni, Cl, S, F and the like as the constituent elements other than above.

In addition, in the sintered magnet, the content of N is preferably 0.15 mass % or less. If the content of N is larger than said range, the coercivity tends to become insufficient.

In addition, the contents of all elements of the sintered magnet of this embodiment are preferably within the above ranges, and at the same time the numbers of C, O and N atoms satisfy a relationship of $[O]/([C]+[N])<0.60$ when they are respectively denoted with [C], [O] and [N]. With such a configuration, the absolute value of the high-temperature demagnetization rate may be suppressed low.

In addition, for the sintered magnet of this embodiment, the numbers of atoms of Nd, Pr, B, C and M elements preferably satisfy the following relationship. That is, when the numbers of atoms of Nd, Pr, B, C and M elements are respectively denoted with [Nd], [Pr], [B], [C] and [M], they preferably satisfy the relationships: $0.27<[B]/([Nd]+[Pr])<0.43$ and $0.07<([M]+[C])/[B]<0.60$. With such a configuration, a high coercivity may be obtained.

An example of the method for producing the rare earth based magnet according to this embodiment is described. The rare earth based magnet according to this embodiment may be produced by a conventional powder metallurgic method comprising a confecting process of confecting the alloy raw materials, a pulverizing process of pulverizing the alloy raw materials into micro powder raw materials, a molding process of molding the micro powder raw materials into a molded body, a sintering process of sintering the molded body into a sintered body, and a heat treating process of subjecting the sintered body to an aging treatment.

The confecting process is a process for confecting the alloy raw materials that contain respective elements contained in the rare earth based magnet according to this embodiment. Firstly, the raw metals having the specified elements are prepared, and subjected to a strip casting method and the like. The alloy raw materials are thus confected. As the metal raw materials, for examples, rare earth metals or rare earth alloys, pure iron, pure cobalt, ferroboron or alloys thereof can be exemplified. These metal raw materials are used to confect the alloy raw materials of the rare earth based magnet having the desired composition.

The pulverizing process is a process for pulverizing the alloy raw materials obtained in the confecting process into micro powder raw materials. This process is preferably performed in two stages comprising a coarse pulverization and a fine pulverization, and may also be performed as one stage. The coarse pulverization may be performed by using, for example, a stamp mill, a jaw crusher, a braun mill, etc under an inert atmosphere. A hydrogen decrepitation in which pulverization is performed after hydrogen adsorption may also be performed. In the coarse pulverization, the alloy raw materials are pulverized until the particle size is around several hundreds of micrometers to several millimeters.

The fine pulverization finely pulverizes the coarse powders obtained in the coarse pulverization, and prepares the micro powder raw materials with the average particle size of several micrometers. The average particle size of the micro powder raw materials may be set under the consideration of the growth of the crystal grains after sintering. For example, the fine pulverization may be performed by a jet mill.

The molding process is a process for molding the micro powder raw materials into a molded body in the magnetic field. Specifically, after the micro powder raw materials are filled into a mold equipped in an electromagnet, the molding is performed by orientating the crystallographic axis of the micro powder raw materials by applying a magnetic field via the electromagnet, while pressurizing the micro powder raw materials. The molding may be performed in a magnetic field of 100~1600 kA/m under a pressure of 30~300 MPa.

The sintering process is a process for sintering the molded body into a sintered body. After being molded in the magnetic field, the molded body may be sintered in a vacuum or an inert atmosphere to obtain a sintered body. Preferably, the sintering conditions are suitably set depending on the conditions such as composition of the molded body, the pulverizing method of the micro powder raw materials, particle size, etc. For example, the sintering may be performed at 1000V~1100° C. for 1~10 hours.

The heat treating process is a process for subjecting the sintered body to an aging treatment. After this process, the width and the composition of the two-grain boundary phases formed between the $R_2T_{14}B$ main-phase crystal grains are determined. However, these microstructures are not controlled only in this process, but determined by considering both the conditions of the above sintering process and the situation of the micro powder raw materials. Hence, the temperature and time period for the heat treatment can be set under the consideration of the relationship between the conditions of the heat treatment and the microstructures of the sintered body. The heat treatment may be performed at a temperature of 500° C.~900° C., and may also be performed in two stages comprising a heat treatment in the vicinity of 800° C. followed by a heat treatment in the vicinity of 550° C. The cooling rate(s) during the cooling process of the heat treatment may also alter the microstructure. The cooling rate is preferably 100° C./min or more, particularly preferably 300° C./min or more. It is considered that by the above aging of the present invention in which the cooling is faster than the prior art, the segregation of the ferromagnetic phase in the grain boundary phases can be effectively inhibited. Thus, the causes for reducing the coercivity and further deteriorating the rate of demagnetization at high temperature can be eliminated. The width of the two-grain boundary phases can be controlled by setting the composition of the raw material alloy, the above sintering conditions and the heat treatment conditions, respectively. As a method for controlling the width of the two-grain boundary phases, an example of the heat treatment process is described herein. The width of the two-grain boundary phases may also be controlled according to the compositional factor as recited in Table 1.

The rare earth based magnet according to this embodiment can be obtained via the above methods. However, the producing method for the rare earth based magnet is not limited to the above methods and can be suitably modified.

Next, the evaluation for the rate of demagnetization at high temperature of the rare earth based magnet according to this embodiment is described. The shape of the sample used for evaluation is not particularly limited, and for example, is generally a shape with a magnetic permeance coefficient of 2. Firstly, residual flux of the sample at a room temperature (25° C.) is measured and taken as B0. The residual flux may be measured by for example a magnetic flux meter. Next, the sample is exposed to a high temperature of 140° C. for 2 hours, and back to the room temperature. Once the temperature of the sample returns to the room temperature, the residual flux is measured again and taken as B1. As such, the rate of demagnetization at high temperature D is evaluated by the formula below.

$$D=(B1-B0)/B0*100(\%)$$

The microstructure of the rare earth based magnet according to this embodiment, i.e., the width of the two-grain boundary phase, may be evaluated via HRTEM. The magnification may be suitably set according to the width of the two-grain boundary phase of the observed object. The sample for which the above high-temperature demagnetization rate has been evaluated is prepared into thin-sheet shape, and the grinded section is subjected to observation. The grinded section may be parallel to the orientation axis, perpendicular to the orientation axis, or form an arbitrary angle with the orientation axis. The specific measuring method is set forth above.

In this embodiment, observation is performed with a scanning transmission electron microscope (STEM), the position of the midpoint 2*c* of the two-grain boundary phase is determined, and further, the content ratios of the elements in the midpoint 2*c* of the two-grain boundary phase are calculated as the composition of the two-grain boundary phase by performing point analysis with the energy dispersive X-ray spectroscopy (STEM-EDS) attached in STEM.

In addition, in this embodiment, the crystal structure and the crystallinity of the two-grain boundary phase are determined by analyzing the images of HRTEM and the images of selected-area electron diffraction or convergent beam electron diffraction in the vicinity of the midpoints 2*c* of the two-grain boundary phases.

Next, this invention will be described in more detail based on specific examples. However, this invention is not limited to the following examples.

EXAMPLES

Firstly, the metal raw materials of the sintered magnet are prepared, and alloy raw materials are respectively prepared by a strip casting method using the metal raw materials in a way that the compositions of sintered magnets of samples No. 1 to No. 18 and comparative examples 1 to 3 shown in the following Table 1 can be obtained. In addition, regarding the contents of the elements shown in Tables 1 and 2, for T, R, Cu and M, measuring is performed by X-ray fluorescence analysis, and for B, measuring is performed by ICP luminescence analysis. Further, for O, measuring may be performed by the inert gas fusion-nondispersive infrared absorption method, for C, measuring may be performed by the combustion in oxygen flow-infrared absorption method, and for N, measuring may be performed by the inert gas fusion-thermal conductivity method. Further, regarding [O]/([C]+[N]), [B]/([Nd]+[Pr]) and ([M]+[C])/[B], they are calculated by acquiring the numbers of atoms of the elements using the contents obtained by the above methods.

Next, after adsorption of hydrogen onto the resultant alloy raw materials, a hydrogen pulverization for desorbing hydrogen was performed in Ar atmosphere at 600° C. for 1 hour. Then the resultant pulverized material was cooled to room temperature in Ar atmosphere.

After adding oleic acid amide as the pulverization agent to the resultant pulverized material and mixing therewith, a fine pulverization was performed by using a jet mill to obtain powder raw materials with an average particle size of 3~4 μm.

The resultant powder raw materials were molded in a low-oxygen atmosphere under a condition of an orientating magnetic field of 1200 kA/m and a molding pressure of 120 MPa to obtain a molded body.

Subsequently, after being sintered in vacuum at 1030 to 1050° C. for 4 hours, the molded body is quenched to obtain a sintered body. The obtained sintered body is subjected to a two-stage heat treatment, i.e., at 900° C. and 500° C. Regarding the heat treatment at 900° C. in the first stage (aging 1), 1 hour and a cooling rate of 100° C./min are specified; regarding the heat treatment at 500° C. in the second stage (aging 2), the heat treatment time and the cooling rate during temperature decreasing in the heat treatment are changed, and various samples with different widths of the two-grain boundary phases are prepared. Further, as mentioned above, the widths of said two-grain boundary phases may also alter according to the composition of the raw material alloys and the sintering conditions.

Regarding the resultant samples above, the residual magnetic flux density and the coercivity are respectively determined using a B—H tracer. Then the high-temperature demagnetization rate is determined, and next, width of the two-grain boundary phases is measured by observing the section with an electron microscope, and identification on materials composing the two-grain boundary phases is performed. Firstly, the microstructures and the magnetic characteristics of various samples are summarized and shown in Table 1. In addition, various kinds of two-grain boundary phases are observed, and judging from the compositions and structures, those with two-grain boundary phase observed are denoted with ○ in Table 1, and those without the two-grain boundary phase observed are denoted with × in Table 1. Further, samples with microstructures of the prior art are also represented as comparative examples in Table 1.

In addition, the cooling rate of the heat treatment in the second stage (aging 2) is shown in Table 2. Further, when the numbers of atoms of C, O, N, Nd, Pr, B, M elements contained in the sintered body are denoted as [C], [O], [N], [Nd], [Pr], [B] and [M] respectively, the values of [O]/([C]+[N]), [B]/([Nd]+[Pr]) and ([M]+[C])/[B] are calculated for each sample and shown in Table 2. The contents of oxygen and nitrogen contained in the rare earth based magnet are adjusted to the ranges in Table 2 by controlling the atmosphere from the pulverization process to the heat treatment process, especially by increasing or decreasing the contents of oxygen and nitrogen contained in the atmosphere in the pulverization process. Further, the carbon content in the raw materials contained in the rare earth based magnet is adjusted to the range in Table 2 by increasing or decreasing the amount of the pulverization agent added in the pulverization process.

TABLE 1

| | Composition of the sintered magnet (mass %) | | | | | | | | | | | | Sintering | | Aging 1 | | Aging 2 | |
|---|---|---|---|---|---|---|---|---|---|---|---|---|---|---|---|---|---|---|
| | R | | | | | | M | | | | | | Temp. | Time | Temp. | Time | Temp. | Time |
| Sample No. | Total | Nd | Pr | Dy | B | Cu | Al | Ga | Si | Ge | Sn | Fe | ° C. | hr | ° C. | hr | ° C. | hr |
| Sample No. 1 | 33.0 | 33.0 | 0.0 | 0.0 | 0.70 | 0.7 | 0.2 | 1.3 | 0.0 | 0.0 | 0.0 | bal. | 1030 | 4 | 900 | 1 | 500 | 20 |
| Sample No. 2 | 33.0 | 33.0 | 0.0 | 0.0 | 0.70 | 0.7 | 0.2 | 1.3 | 0.0 | 0.0 | 0.0 | bal. | 1030 | 4 | 900 | 1 | 500 | 1 |
| Sample No. 3 | 32.5 | 32.5 | 0.0 | 0.0 | 0.80 | 0.4 | 0.2 | 0.7 | 0.0 | 0.0 | 0.0 | bal. | 1030 | 4 | 900 | 1 | 500 | 20 |
| Sample No. 4 | 32.5 | 32.5 | 0.0 | 0.0 | 0.80 | 0.4 | 0.2 | 0.7 | 0.0 | 0.0 | 0.0 | bal. | 1030 | 4 | 900 | 1 | 500 | 1 |

TABLE 1-continued

| | | | | | | | | | | | | | | | | | | |
|---|---|---|---|---|---|---|---|---|---|---|---|---|---|---|---|---|---|---|
| Sample No. 5 | 32.0 | 32.0 | 0.0 | 0.0 | 0.83 | 0.1 | 0.2 | 0.5 | 0.0 | 0.0 | 0.0 | bal. | 1030 | 4 | 900 | 1 | 500 | 20 |
| Sample No. 6 | 32.0 | 32.0 | 0.0 | 0.0 | 0.83 | 0.1 | 0.2 | 0.5 | 0.0 | 0.0 | 0.0 | bal. | 1030 | 4 | 900 | 1 | 500 | 10 |
| Sample No. 7 | 32.0 | 32.0 | 0.0 | 0.0 | 0.83 | 0.1 | 0.2 | 0.5 | 0.0 | 0.0 | 0.0 | bal. | 1030 | 4 | 900 | 1 | 500 | 5 |
| Sample No. 8 | 32.0 | 32.0 | 0.0 | 0.0 | 0.83 | 0.1 | 0.2 | 0.5 | 0.0 | 0.0 | 0.0 | bal. | 1030 | 4 | 900 | 1 | 500 | 1 |
| Sample No. 9 | 32.0 | 32.0 | 0.0 | 0.0 | 0.83 | 0.1 | 0.2 | 0.0 | 0.3 | 0.0 | 0.0 | bal. | 1030 | 4 | 900 | 1 | 500 | 1 |
| Sample No. 10 | 32.0 | 32.0 | 0.0 | 0.0 | 0.83 | 0.1 | 0.2 | 0.0 | 0.0 | 0.3 | 0.0 | bal. | 1030 | 4 | 900 | 1 | 500 | 1 |
| Sample No. 11 | 32.0 | 32.0 | 0.0 | 0.0 | 0.83 | 0.1 | 0.2 | 0.0 | 0.0 | 0.0 | 0.3 | bal. | 1030 | 4 | 900 | 1 | 500 | 1 |
| Sample No. 12 | 32.0 | 32.0 | 0.0 | 0.0 | 0.83 | 0.1 | 0.5 | 0.0 | 0.0 | 0.0 | 0.0 | bal. | 1030 | 4 | 900 | 1 | 500 | 1 |
| Sample No. 13 | 31.5 | 31.5 | 0.0 | 0.0 | 0.87 | 0.1 | 0.2 | 0.3 | 0.0 | 0.0 | 0.0 | bal. | 1030 | 4 | 900 | 1 | 500 | 1 |
| Sample No. 14 | 31.5 | 31.5 | 0.0 | 0.0 | 0.92 | 0.1 | 0.2 | 0.2 | 0.0 | 0.0 | 0.0 | bal. | 1030 | 4 | 900 | 1 | 500 | 1 |
| Sample No. 15 | 31.0 | 31.0 | 0.0 | 0.0 | 0.95 | 0.1 | 0.2 | 0.2 | 0.0 | 0.0 | 0.0 | bal. | 1050 | 4 | 900 | 1 | 500 | 1 |
| Sample No. 16 | 30.5 | 30.5 | 0.0 | 0.0 | 0.95 | 0.1 | 0.2 | 0.0 | 0.0 | 0.0 | 0.0 | bal. | 1050 | 4 | 900 | 1 | 500 | 1 |
| Sample No. 17 | 32.0 | 25.0 | 7.0 | 0.0 | 0.83 | 0.1 | 0.2 | 0.5 | 0.0 | 0.0 | 0.0 | bal. | 1030 | 4 | 900 | 1 | 500 | 1 |
| Sample No. 18 | 32.0 | 31.0 | 0.0 | 1.0 | 0.83 | 0.1 | 0.2 | 0.5 | 0.0 | 0.0 | 0.0 | bal. | 1030 | 4 | 900 | 1 | 500 | 1 |
| Comparative example 1 | 33.0 | 33.0 | 0.0 | 0.0 | 0.70 | 0.7 | 0.2 | 1.3 | 0.0 | 0.0 | 0.0 | bal. | 1030 | 4 | 900 | 1 | 500 | 72 |
| Comparative example 2 | 30.0 | 30.0 | 0.0 | 0.0 | 1.00 | 0.5 | 0.2 | 0.0 | 0.0 | 0.0 | 0.0 | bal. | 1050 | 4 | 900 | 1 | 500 | 1 |
| Comparative example 3 | 30.5 | 22.0 | 6.5 | 2.0 | 1.00 | 0.5 | 0.2 | 0.0 | 0.0 | 0.0 | 0.0 | bal. | 1050 | 4 | 900 | 1 | 500 | 1 |

| | Magnetic characteristics | | | Two-grain boundary phases | | | | | |
|---|---|---|---|---|---|---|---|---|---|
| | | | | | | composition | | | |
| Sample No. | Br kG | Hcj kOe | High-temperature demagnetization rate % | Average thickness nm | Ratio of thick Two-grain boundary phases satisfying the magnetism % | Nd ≥ 90 at % | Nd ≥ 60 at % | Nd ≤ 20 at % | $R_6T_{13}M$ phase |
| Sample No. 1 | 13.3 | 26.0 | −0.2 | 490 | 100% | ○ | ○ | x | ○ |
| Sample No. 2 | 13.3 | 25.0 | −0.2 | 332 | 98% | ○ | ○ | x | ○ |
| Sample No. 3 | 13.5 | 24.0 | −0.3 | 290 | 100% | ○ | ○ | x | ○ |
| Sample No. 4 | 13.5 | 23.0 | −0.3 | 220 | 100% | ○ | ○ | x | ○ |
| Sample No. 5 | 13.7 | 23.0 | −0.3 | 210 | 97% | ○ | ○ | x | ○ |
| Sample No. 6 | 13.7 | 22.5 | −0.4 | 178 | 100% | ○ | ○ | x | ○ |
| Sample No. 7 | 13.7 | 22.0 | −0.4 | 130 | 98% | ○ | ○ | x | ○ |
| Sample No. 8 | 13.7 | 21.7 | −0.3 | 110 | 100% | ○ | ○ | x | ○ |
| Sample No. 9 | 13.7 | 19.5 | −0.9 | 53 | 65% | ○ | ○ | x | ○ |
| Sample No. 10 | 13.7 | 19.2 | −1.0 | 59 | 68% | ○ | ○ | x | ○ |
| Sample No. 11 | 13.7 | 19.4 | −0.8 | 48 | 60% | ○ | ○ | x | ○ |
| Sample No. 12 | 13.6 | 19.8 | −0.7 | 63 | 43% | ○ | ○ | x | ○ |
| Sample No. 13 | 13.8 | 20.0 | −0.7 | 81 | 78% | ○ | ○ | x | ○ |
| Sample No. 14 | 13.9 | 19.0 | −1.2 | 18 | 63% | ○ | ○ | x | ○ |
| Sample No. 15 | 14.0 | 18.0 | −1.5 | 12 | 52% | ○ | ○ | ○ | ○ |
| Sample No. 16 | 14.1 | 17.0 | −1.8 | 5 | 35% | ○ | ○ | ○ | ○ |
| Sample No. 17 | 13.7 | 21.7 | −0.3 | 126 | 98% | ○ | ○ | x | ○ |
| Sample No. 18 | 13.5 | 24.0 | −0.3 | 131 | 98% | ○ | ○ | x | ○ |
| Comparative example 1 | 12.6 | 15.9 | −0.1 | 880 | 100% | ○ | ○ | x | ○ |
| Comparative example 2 | 14.2 | 15.0 | −8.0 | 1.8 | 5% | x | x | ○ | x |
| Comparative example 3 | 13.8 | 18.0 | −4.0 | 6 | 15% | x | x | ○ | x |

TABLE 2

| | Contents of N, C, O in sintered body | | | Cooling rate in | | | |
|---|---|---|---|---|---|---|---|
| | | | | | Ratio of atom numbers | | |
| Sample No. | N mass % | C mass % | O mass % | aging 2 ° C./min | [B]/([Nd] + [Pr]) | ([M] + [C]/[B]) | [O]/([C] + [N]) |
| Sample No. 1 | 0.05 | 0.15 | 0.10 | 600 | 0.28 | 0.59 | 0.39 |
| Sample No. 2 | 0.05 | 0.15 | 0.09 | 600 | 0.28 | 0.59 | 0.35 |
| Sample No. 3 | 0.04 | 0.14 | 0.09 | 300 | 0.33 | 0.39 | 0.39 |
| Sample No. 4 | 0.04 | 0.13 | 0.08 | 300 | 0.33 | 0.38 | 0.37 |
| Sample No. 5 | 0.04 | 0.14 | 0.09 | 600 | 0.35 | 0.34 | 0.39 |
| Sample No. 6 | 0.05 | 0.13 | 0.08 | 600 | 0.35 | 0.33 | 0.35 |
| Sample No. 7 | 0.04 | 0.13 | 0.07 | 600 | 0.35 | 0.33 | 0.32 |
| Sample No. 8 | 0.04 | 0.14 | 0.06 | 600 | 0.35 | 0.34 | 0.26 |
| Sample No. 9 | 0.04 | 0.10 | 0.09 | 100 | 0.35 | 0.34 | 0.51 |
| Sample No. 10 | 0.06 | 0.10 | 0.09 | 100 | 0.35 | 0.26 | 0.45 |
| Sample No. 11 | 0.05 | 0.11 | 0.09 | 100 | 0.35 | 0.25 | 0.44 |

TABLE 2-continued

| Sample No. | Contents of N, C, O in sintered body N mass % | C mass % | O mass % | Cooling rate in aging 2 ° C./min | Ratio of atom numbers [B]/([Nd] + [Pr]) | ([M] + [C]/[B]) | [O]/([C] + [N]) |
|---|---|---|---|---|---|---|---|
| Sample No. 12 | 0.04 | 0.12 | 0.09 | 100 | 0.35 | 0.37 | 0.44 |
| Sample No. 13 | 0.04 | 0.10 | 0.08 | 300 | 0.37 | 0.25 | 0.45 |
| Sample No. 14 | 0.04 | 0.09 | 0.09 | 550 | 0.39 | 0.21 | 0.55 |
| Sample No. 15 | 0.05 | 0.09 | 0.09 | 300 | 0.41 | 0.20 | 0.51 |
| Sample No. 16 | 0.04 | 0.10 | 0.10 | 400 | 0.42 | 0.18 | 0.56 |
| Sample No. 17 | 0.04 | 0.09 | 0.06 | 600 | 0.34 | 0.29 | 0.36 |
| Sample No. 18 | 0.04 | 0.09 | 0.06 | 600 | 0.36 | 0.29 | 0.36 |
| Comparative example 1 | 0.04 | 0.12 | 0.10 | 500 | 0.28 | 0.56 | 0.49 |
| Comparative example 2 | 0.04 | 0.09 | 0.12 | 40 | 0.44 | 0.16 | 0.73 |
| Comparative example 3 | 0.04 | 0.10 | 0.11 | 60 | 0.47 | 0.17 | 0.62 |

It can be known from Table 1 that, in the samples of this embodiment in which the width of the two-grain boundary phases is 5 nm or more, the high-temperature demagnetization rate is suppressed relatively low, i.e., −2% or less, forming a rare earth based magnet that is also applicable for applications in a high temperature environment. However, in comparative example 1 in which the width of the two-grain boundary phases exceeds 500 nm, although the high-temperature demagnetization rate is suppressed to be very low, the residual magnetic flux density Br decreases to 12.6 kG, which is problematic in actual application. This may attribute to the excessively large volume percentage occupied by nonferromagnetic two-grain boundary phases relative to the entire rare earth based magnet. On the other hand, in comparative example 2, the two-grain boundary phases are as narrow as 1.8 nm in width, and thus the magnetic cutting-off effect between the main-phase crystal grains cannot be realized and the high-temperature demagnetization rate cannot be suppressed. In comparative example 3, although the width of the two-grain boundary phases is 6 nm, which is thicker than the value in the prior art, and further the coercivity at room temperature is equal to that of sample No. 15, there is no suppression effect on high-temperature demagnetization rate. As mentioned hereinafter, this is believed to caused by that the two-grain boundary phases are formed with Nd—Cu(—Fe) phase containing massive iron group elements. In addition, as a result of the analysis on the electron microscope photos of these samples, the ratio of thick two-grain boundary phases is 20% or more.

Figure 3:
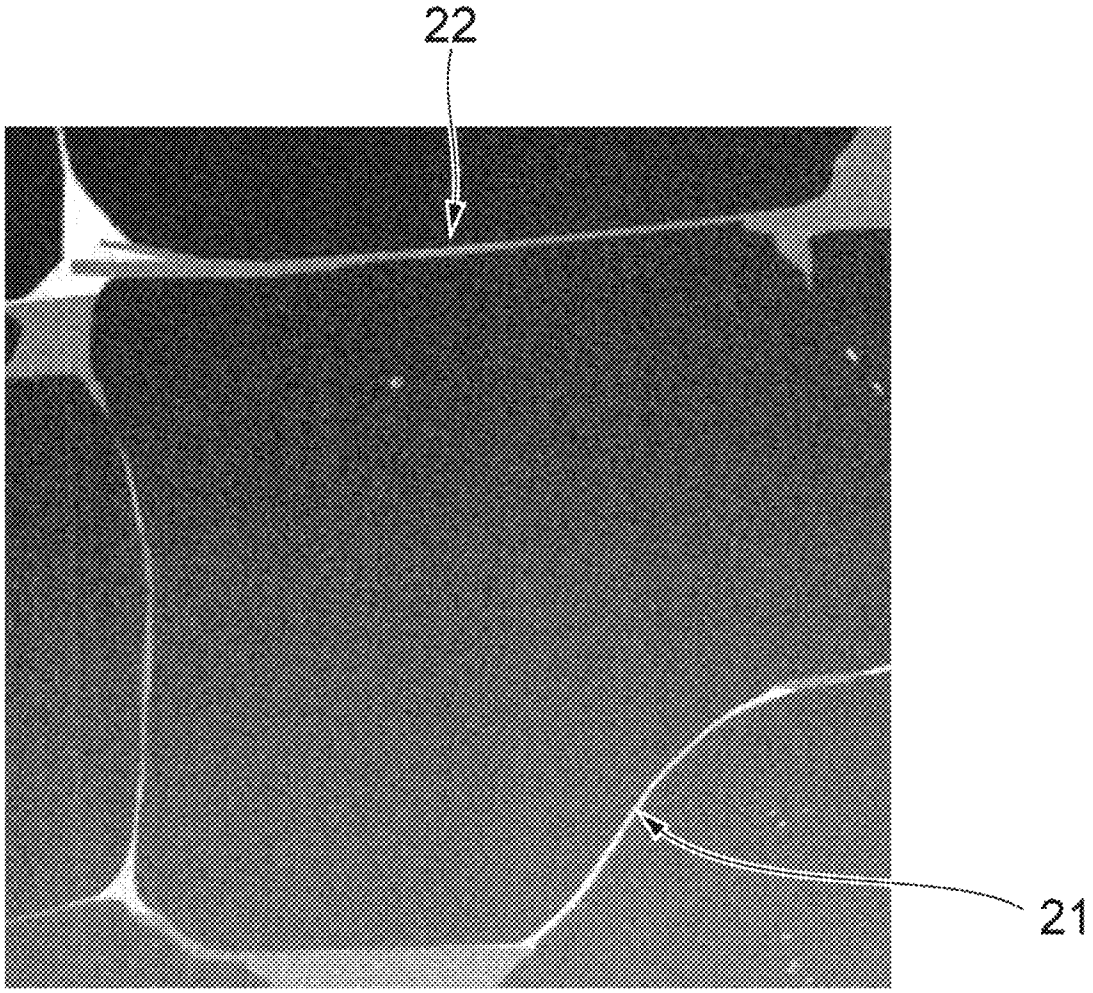
FIG. 3 is a diagram representing the first and the second two-grain boundary phases.

Next, the two-grain boundary phases in the rare earth based magnet according to this invention will be described in more detail. FIG. 3 is an electron microscope image representing the two kinds of two-grain boundary phases formed in sample No. 8. The first two-grain boundary phase 21 is analyzed by STEM-EDS, and it turns out to be a Nd—Ga phase containing Nd in a high concentration. Specifically, it is a Nd—Ga phase containing Nd at an atomic concentration of 90 at %, which forms a nonferromagnetic two-grain boundary phase. Regarding the second two-grain boundary phase 22, HRTEM and the selected-area electron diffraction picture are studied, and lattice images and diffraction spots are observed which imply the formation of $La_6Co_{11}Ga_3$-type crystal structure. According to the analysis results and the structure obtained from STEM-EDS, it is determined that a $Nd_6Fe_{13}Ga$ compound is formed. Although said compound contains Fe, it is a nonferromagnetic two-grain boundary phase. It can be known from analysis on the magnetic flux distribution in electron holography of said compound that, the magnetization value is very small, and it is considered that whether said compound is a compound exhibiting antiferromagnetism or ferrimagnetism. It is believed that the magnetic coupling between main-phase crystal grains can be cut off and the high-temperature demagnetization rate can be suppressed by, as mentioned above, making the two-grain boundary phases have a thickness of 5 nm or more and be composed of materials with non-ferromagnetism.

Figure 4B:
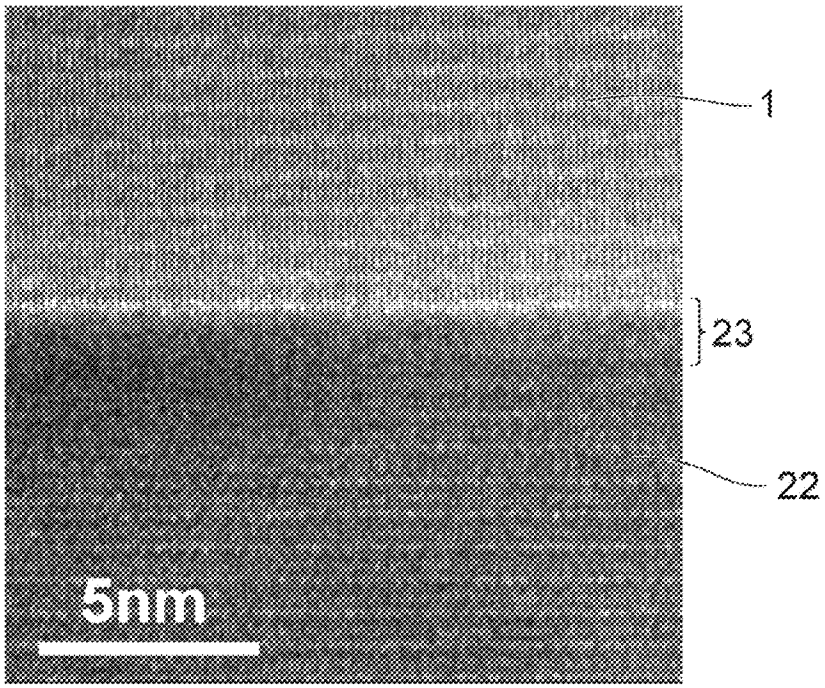
FIG. 4B is a HRTEM image of further observation for the boundaries of the two phases in FIG. 4A.
Figure 4A:
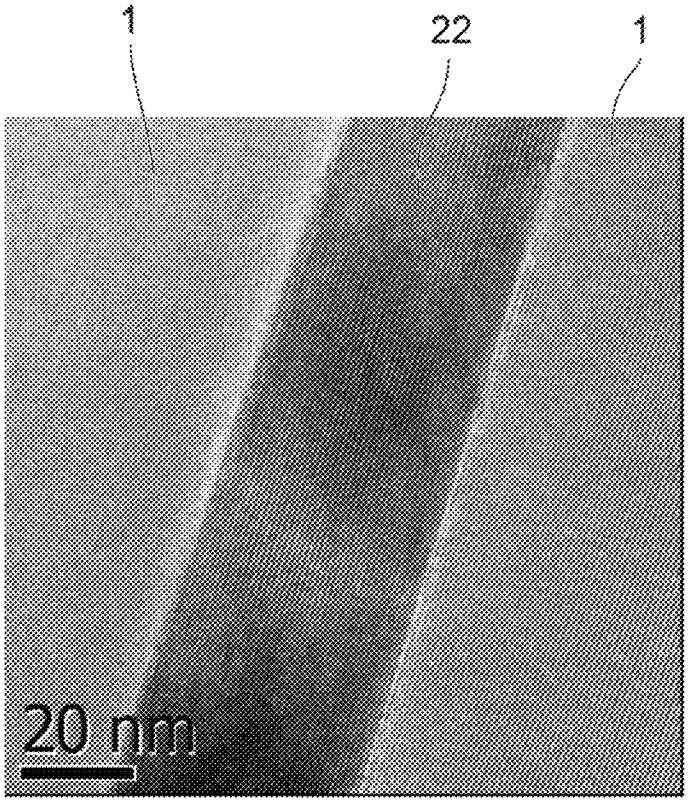
FIG. 4A is a HRTEM image of the second two-grain boundary phase.

The result of a further specific analysis on the above second two-grain boundary phase is shown in FIG. 4. FIG. 4A shows the observation result of the second two-grain boundary phase by HRTEM. Since lattice fringes with good continuity and a high crystallinity are both observed in regions of $R_2T_{14}B$ ($Nd_2Fe_{14}B$) main-phase crystal grains 1 and the second two-grain boundary phase 22, it can be known that not only the main-phase crystal grains, but also the $Nd_6Fe_{13}Ga$ compounds which act as the two-grain boundary phases have an excellent crystallinity. It is believed that thick two-grain boundary phases can be formed uniformly by rendering the crystals with good crystallinity grown into two-grain boundary like this. A image obtained by further observing the boundaries of the two phases in FIG. 4A with a high magnification is the image of FIG. 4B. According to the analysis on HRTEM and the electron diffraction images and the analysis with STEM-EDS, it can be determined that a thin Nd—Cu layer 23 of about 1 to 2 nm is formed on the boundary of the $R_2T_{14}B$ main-phase crystal grains 1 and the second two-grain boundary phase 22. Said Nd—Cu layer 23 is amorphous and is considered to act as a buffer layer between the two crystal phases. As a result, the boundary becomes smooth, the occurrence of distortion due to lattice mismatch and the like can be suppressed, and formation of a reverse magnetic domain-generating nuclei and the high-temperature demagnetization rate can be suppressed. In addition, said thin boundary phase 23 is also observed in samples No. 1 to No. 18 in which a $R_6T_{13}M$ phase is formed, as well as in comparative example 1.

Subsequently, the two-grain boundary phases formed in sample No. 13 will be described. In sample No. 13, it can be determined that there are two kinds of R—Ga(Nd—Ga) two-grain boundary phases with different compositions. In many samples of the present example, R-M two-grain boundary phases with such different compositions can also be confirmed to be present. In addition to the above Nd—Ga two-grain boundary phases which contain 90 at % or more of Nd, the two-grain boundary phases may also be composed of a Nd—Ga two-grain boundary phases containing about 60 at % of Nd. In this situation, the component elements acting as the balance include Ga, Fe, and Cu, etc, forming a non-ferromagnetic two-grain boundary phases, wherein Nd+Ga+Cu is about 80 at %.

Figure 5B:
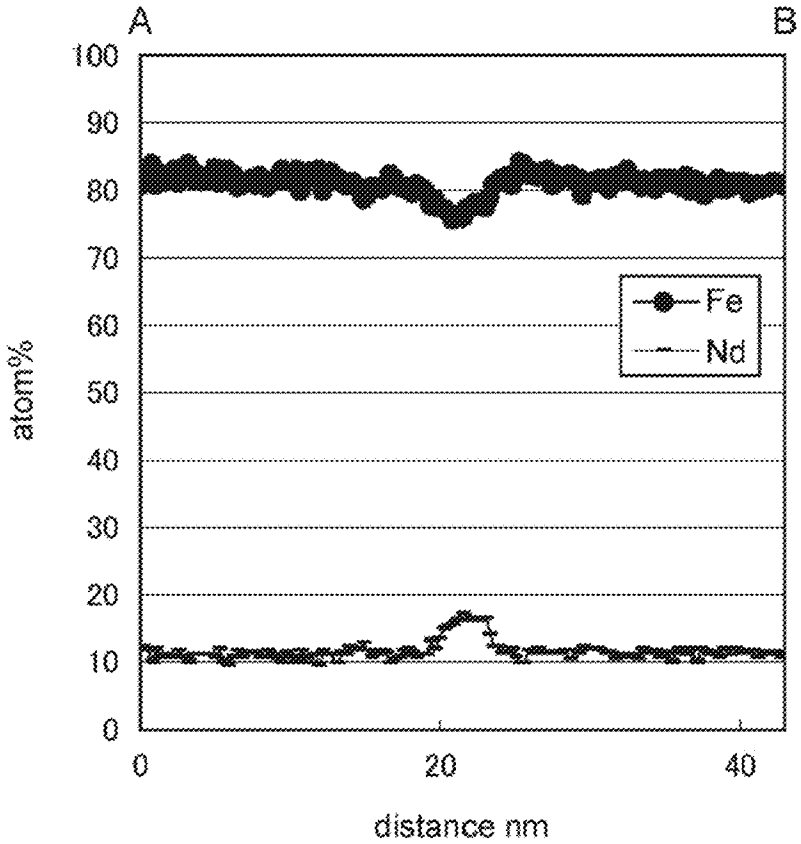
FIG. 5B is a diagram of the concentration distribution of Fe and Nd of the two-grain boundary phase shown in FIG. 5A.
Figure 5A:
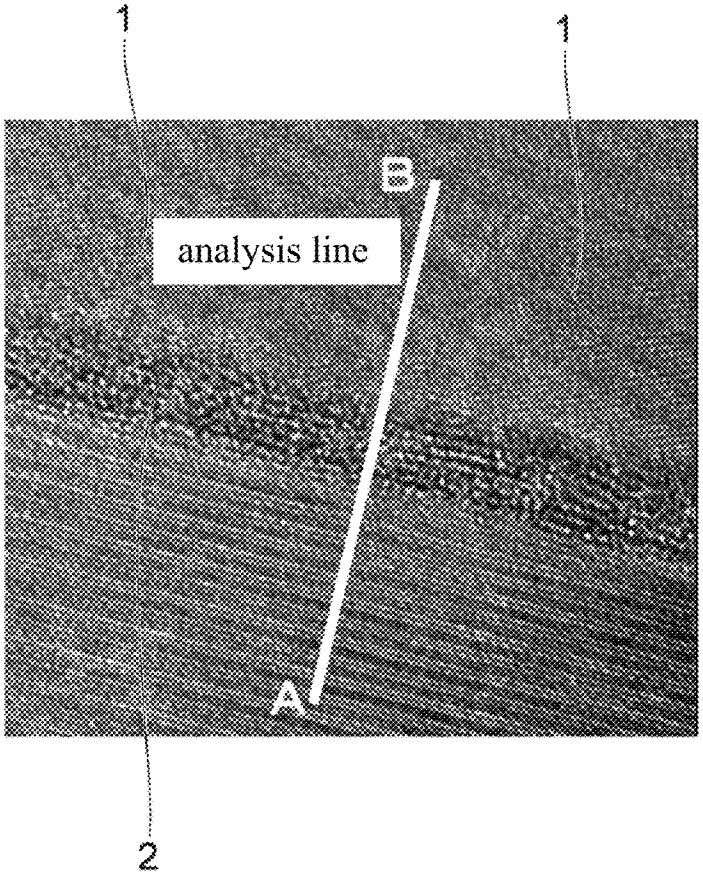
FIG. 5A is a HRTEM image of the two-grain boundary phases of the prior art.

FIG. 5A represents a HRTEM image of the two-grain boundary phases of the comparative example 3 which is obtained by prior art. FIG. 5B represents the concentration distribution of Fe and Nd acquired by performing line analysis in the interval A-B in the figure of the two-grain boundary phase 2 shown in FIG. 5A with STEM-EDS. According to the element analysis results obtained from said STEM-EDS, the two-grain boundary phases of said comparative example 3 contains 75.8 at % of Fe atoms, and it is presumed to be ferromagnetic. Thus, in the two-grain boundary phases formed in the prior art in which the iron group elements are present at a high concentration, even if the width of the two-grain boundary phases can be made 5 nm or more, the magnetic cutting-off effect between main-phase crystal grains cannot be achieved. Accordingly, the suppression effect on high-temperature demagnetization rate cannot be improved.

In addition, as shown in Table 2, among the samples 1 to 18 satisfying the requirements of the present invention, the above microstructure is formed in the sintered magnet, and the numbers of atoms of Nd, Pr, B, C and M elements contained in the sintered magnet respectively satisfy the following specific relationships. That is, when denoting the numbers of atoms of Nd, Pr, B, C and M elements with [Nd], [Pr], [B], [C] and [M], the relationships $0.27<[B]/([Nd]+[Pr])<0.43$ and $0.07<([M]+[C])/[B]<0.60$ are satisfied. As such, by satisfying the relationships of $0.27<[B]/([Nd]+[Pr])<0.43$ and $0.07<([M]+[C])/[B]<0.60$, the coercivity (Hcj) can be effectively increased.

In addition, as shown in Table 2, among the samples 1 to 18 satisfying the requirements of the present invention, the above microstructure is formed in the sintered magnet, and the numbers of atoms of O, C and N contained in the sintered magnet satisfy the following specific relationship. That is, when denoting the numbers of atoms of O, C and N with [O], [C] and [N], the relationship of $[O]/([C]+[N])<0.60$ is satisfied. As such, by satisfying the relationship of $[O]/([C]+[N])<0.60$, the high-temperature demagnetization rate D can be effectively suppressed.

Hereinabove, the present invention is described based on the embodiments. The embodiments are illustrative, which can be subjected to various variation and modification within the scope of the claims of this invention. In addition, those skilled in the art that can understand that such variant examples and modifications are within the scope of the claims of this invention. Thus, the description of the present specification and the drawings should be deemed as illustrative but not limiting.

According to the present invention, a rare earth based magnet that may be used even at a high temperature environment can be provided.

DESCRIPTION OF REFERENCE NUMERALS

1 Main-phase crystal grains
2 Two-grain boundary phases
2*a*, 2*b* Boundaries
2*c* The midpoint of the two-grain boundary phase
21 The first two-grain boundary phase
22 The second two-grain boundary phase
23 Boundary layer
3 Triple junction
100 Sintered magnet

What is claimed is:

1. A rare earth based magnet comprising:

$R_2T_{14}B$ main-phase crystal grains, where R is at least one element selected from the group consisting of rare earth elements, and T is Fe or the combination of Fe and Co, the rare earth based magnet contains M and Cu, M is at least one element selected from the group consisting of Al, Ge, Si, Sn, and Ga, contents of the elements relative to the total mass are shown as follows:

R: 30.5 to 33 mass %,

B: 0.7 to 0.92 mass %,

M: 0.2 to 1.5 mass %,

Cu: 0.1 to 0.7 mass %, and

Fe: balance, substantially, and the total content of elements other than Fe occupying the balance: 5 mass % or lower, the content of heavy rare earth elements in total mass of the sintered magnet is 0.1 mass % or less, and two-grain boundary phases between adjacent two $R_2T_{14}B$ main-phase crystal grains, wherein the two-grain boundary phases have an average thickness of the two-grain boundary phases in any section with respect to all measuring points in a range of 5 nm or more and 490 nm or less, the thickness of the two-grain boundary phases is the thickness evaluated via HRTEM, the measuring points are points in which three points are present on each two-grain boundary phase in any section, the three points which are present on each two-grain boundary phase are determined by two boundaries between the two-grain boundary phase and triple junctions connecting thereto, the interval between the two boundaries is quadrisected, and when three quadrisectors are drawn, the three points are located at positions of the three quadrisectors, a thickness of each two-grain boundary phase on which the three points are present is a distance between the two $R_2T_{14}B$ main-phase crystal grains on the three quadrisectors, the average thickness of the two-grain boundary phases is an average of measured values of 60 measuring points in 20 arbitrarily selected two-grain boundary phases, at least some of the two-grain boundary phases are composed of a phase with a magnetism different from that of the $R_2T_{14}B$ main-phase, the two-grain boundary phases contain a rare earth element and the atomic concentration of the rare earth element in at least one of the two-grain boundary phases is 90 at % or more, a $R_6T_{13}M$ phase and a layer are formed in at least one of the two-grain boundary phases, the layer is a thin microcrystal layer, an amorphous layer, or a microcrystal-containing amorphous layer, and the layer is formed in the boundary between the $R_6T_{13}M$ phases and the $R_2T_{14}B$ main-phase crystal grains and a thickness of the layer is 0.5 nm or more and 1/10 of the thickness of the $R_6T_{13}M$ two-grain boundary phase or less.

2. The rare earth based magnet according to claim 1, wherein, with respect to all measuring points, a ratio of measuring points which are composed of a phase with a magnetism different from that of the $R_2T_{14}B$ main phase and have the two-grain boundary phases being 5 nm or more and 490 nm or less in thickness is 20% or more.

3. The rare earth based magnet according to claim 2, wherein the $R_6T_{13}M$ phase has a $La_6Co_{11}Ga_3$ crystal structure.

4. The rare earth based magnet according to claim 2, further comprising at least two kinds of two-grain boundary phases of a first two-grain boundary phase and a second two-grain boundary phase, wherein, in the first two-grain boundary phase the atomic concentration of rare earth element is 90 at % or more, and the second two-grain boundary phase contains the $R_6T_{13}M$ phase with a $La_6Co_{11}Ga_3$ crystal structure.

5. The rare earth based magnet according to claim 1, wherein the $R_6T_{13}M$ phase has a $La_6Co_{11}Ga_3$ crystal structure.

6. The rare earth based magnet according to claim 1, further comprising at least two kinds of two-grain boundary phases of a first two-grain boundary phase and a second two-grain boundary phase, wherein, in the first two-grain boundary phase the atomic concentration of rare earth element is 90 at % or more, and the second two-grain boundary phase contains the $R_6T_{13}M$ phase with a $La_6Co_{11}Ga_3$ crystal structure.

7. The rare earth based magnet according to claim 1, wherein the rare earth element represents at least one selected from the group consisting of Nd and Pr.

8. The rare earth based magnet according to claim 1, wherein the rare earth based magnet contains O, C and N, the content of C is 0.1 to 0.25 mass %, the content of O is 0.05 to 0.25 mass %, and the content of N is 0.15 mass % or less.

9. The rare earth based magnet according to claim 8, wherein the numbers of O, C and N atoms contained in the rare earth based magnet are referred to as [O], [C] and [N], $$[O]/([C]+[N])<0.60.$$

10. The rare earth based magnet according to claim 1, wherein

R represents at least one selected from Nd and Pr, the rare earth based magnet contains C, the numbers of Nd, Pr, B, C and M atoms contained in the rare earth based magnet are referred to as [Nd], [Pr], [B], [C] and [M], $$0.27<[B]/([Nd]+[Pr])<0.40 \text{ and } 0.07<([M]+[C])/[B]<0.60.$$

11. A rare earth based magnet comprising:

$R_2T_{14}B$ main-phase crystal grains, where R is at least one element selected from the group consisting of rare earth elements, and T is Fe or the combination of Fe and Co, and the rare earth based magnet contains M and Cu, M is at least one element selected from the group consisting of Al, Ge, Si, Sn, and Ga, contents of the elements relative to the total mass are shown as follows:

R: 30.5 to 33 mass %,

B: 0.7 to 0.92 mass %,

M: 0.2 to 1.5 mass %,

Cu: 0.1 to 0.7 mass %, and

Fe: balance, substantially, and the total content of elements other than Fe occupying the balance: 5 mass % or lower, the content of heavy rare earth elements in total mass of the sintered magnet is 0.1 mass % or less, and two-grain boundary phases between adjacent two $R_2T_{14}B$ main-phase crystal grains, wherein the two-grain boundary phases have an average thickness of the two-grain boundary phases in any section with respect to all measuring points in a range of 5 nm or more and 490 nm or less, the thickness of the two-grain boundary phases is the thickness evaluated via HRTEM, the measuring points are points in which three points are present on each two-grain boundary phase in any section, the three points which are present on each two-grain boundary phase are determined by two boundaries between the two-grain boundary phase and triple junctions connecting thereto, the interval between the two boundaries is quadrisected, and when three quadrisectors are drawn, the three points are located at positions of the three quadrisectors, a thickness of each two-grain boundary phase on which the three points are present is a distance between the two $R_2T_{14}B$ main-phase crystal grains on the three quadrisectors, the average thickness of the two-grain boundary phases is an average of measured values of 60 measuring points in 20 arbitrarily selected two-grain boundary phases, a $R_6T_{13}M$ phase and a layer are formed in at least one of the two-grain boundary phases, the layer is a thin microcrystal layer, an amorphous layer, or a microcrystal-containing amorphous layer, wherein the layer is formed in the boundary between the $R_6T_{13}M$ phases and the $R_2T_{14}B$ main-phase crystal grains and a thickness of the layer is 0.5 nm or more and 1/10 of the thickness of the $R_6T_{13}M$ two-grain boundary phase or less.

12. The rare earth based magnet according to claim 11, wherein the rare earth based magnet contains O, C and N, the content of C is 0.1 to 0.25 mass %, the content of O is 0.05 to 0.25 mass %, and the content of N is 0.15 mass % or less.

13. The rare earth based magnet according to claim 12, wherein the numbers of O, C and N atoms contained in the rare earth based magnet are referred to as [O], [C] and [N], $$[O]/([C]+[N])<0.60.$$

14. The rare earth based magnet according to claim 11, wherein

R represents at least one selected from Nd and Pr, the rare earth based magnet contains C, the numbers of Nd, Pr, B, C and M atoms contained in the rare earth based magnet are referred to as [Nd], [Pr], [B], [C] and [M], $$0.27<[B]/([Nd]+[Pr])<0.40 \text{ and } 0.07<([M]+[C])/[B]<0.60.$$

* * * * *